US005525055A

United States Patent [19]

Menter et al.

[11] Patent Number: 5,525,055

[45] Date of Patent: Jun. 11, 1996

[54] APPARATUS FOR PRESETTING FUEL CELL WICK

[75] Inventors: J. Alan Menter; Robert C. Zimmerman, both of Manlius, N.Y.

[73] Assignee: Hollowick, Inc., Manlius, N.Y.

[21] Appl. No.: 398,958

[22] Filed: Mar. 2, 1995

[51] Int. Cl.[6] ..... F23D 3/24

[52] U.S. Cl. ..... 431/320; 431/325; 431/298; 126/45; 126/49

[58] Field of Search ..... 431/320 325, 431/120, 121, 298, 265; 126/45, 49; 220/355, 356

[56] References Cited

U.S. PATENT DOCUMENTS 4,526,530 7/1985 Menter et al. .
4,611,986 9/1986 Menter et al. .
4,624,633 11/1986 Bandel ..... 431/320
4,725,225 2/1988 Gravity ..... 431/320
4,960,219 10/1990 Jordan et al. ..... 220/355
5,211,553 5/1993 Menter et al. .

*Primary Examiner* James C. Yeung
*Attorney, Agent, or Firm* Harris Beach & Wilcox

[57] ABSTRACT

A cap for closing the burner of a liquid fuel cell and protecting the burner wick. The burner wick has upraised adjustable tabs that can be separated to control the heat output of the cell. The cap contains a die member that is arranged to move between the tabs when the cap is closed over the burner to position the tabs at a desired standard heat setting that is best suited for a majority of fuel cell applications.

16 Claims, 1 Drawing Sheet

APPARATUS FOR PRESETTING FUEL CELL WICK

BACKGROUND OF THE INVENTION

This invention relates to a cap for closing the burner of a fuel cell for protecting the upraised tabs of the burner wick and, in particular, of a cap containing an impression die that is arranged to shape tabs of a predetermined configuration when the cap is closed over the burner.

In U.S. Pat. No. 5,211,553, there is described a liquid fuel cell that includes a burner having a divided wick. The wick contains two upraised tabs that can be angularly separated to control the heat output of the fuel cell. Placing the two tabs in face-to-face contact provides for low heat and maximum burning time. On the other hand, extending the length of and angularly displacing the tabs by up to 180° produces high heat and minimum burning time. Most users, however, find that a "standard heat" setting somewhere between the two extreme positions is best suited for their average needs as for example, when warming a chafing dish or the like.

Most fuel cells equipped with adjustable wick tabs are simply put into service without regard to the tab setting which can be "as received" from the factory or in a setting selected by a prior user. This, in turn, generally produces unsatisfactory overheating or underheating. Those users attempting to properly adjust a split wick to a standard or normal setting oftentimes become frustrated in their efforts because of the infinite number of settings available between the two extreme wick settings. Failure to locate the standard heat setting again, results in ineffective fuel cell performance and user dissatisfaction.

As explained in greater detail in the above noted '553 patent, and in U.S. Pat. No. 4,526,530, it is important that the burner employed in this type of fuel cell be properly vented. A primary vent passage is typically arranged so that in addition to venting, it also collects and returns excess fuel from an over saturated wick back to the fuel cell reservoir. A secondary venting system is designed to operate as a stand pipe in the assembly, to relieve the pressure in the reservoir in the event the primary vent passage becomes flooded with liquid fuel. Under the combined venting action of the secondary system and the slight head pressure built up by liquid fuel collected about the primary vent, the surface tension built up about the primary vent openings is overcome, enabling the collected fuel to drain into the reservoir. Once the passage starts to drain, it will normally continue to drain until all of the fuel is completely removed from the passage. It has been found that on occasion the wicking material can become tightly packed within the burner thereby closing the burners' secondary vent channel. This may result in ineffective warming and in extreme cases, burner failure. As will be explained below, the apparatus of the present invention is designed to insure that the burner is properly vented at all times.

SUMMARY OF THE INVENTION

It is a primary object of the present invention to improve fuel cells that utilize separate wick tabs for controlling the heat output of the cell.

A further object of the present invention is to provide a device for automatically positioning the tabs of an adjustable wick to a predetermined setting.

A still further object of the present invention is to provide a cap for closing the burner of a fuel cell employing adjustable wick tabs and shape the tabs to a standard heat setting each time the cap is closed over the burner.

Another object of the present invention is to provide a cap for the burner of a fuel cell that contains an impression die for shaping the tabs of a divided wick to a desired configuration.

Yet another object of the present invention is to provide a cap for a fuel cell burner that automatically opens a secondary vent channel of the burner each time the cap is closed over the burner.

Still another object of the present invention is to provide a fuel cell that can be adjusted to a standard heat setting by simply closing the burner cap.

These and other objects of the present invention are attained by a cap for closing a fuel cell burner that is equipped with adjustable wick tabs. The cap contains an impression die that is arranged to move between the upraised tabs of the wick during closure to shape the wick tabs into a desired configuration frequently used in a significant number of fuel cell applications. An extended probe is mounted upon the impression die that is adapted to move downwardly between the tabs during closure of the cap to open or reopen a secondary vent passage of the burner. The probe also acts as a guide for the impression die to insure the die properly engages the wick tabs during closure of the cap.

BRIEF DESCRIPTION OF THE DRAWINGS

For a better understanding of these and other objects of the present invention, reference will be made to the following detailed description of the invention which is to be read in association with the accompanying drawings wherein.

DESCRIPTION OF THE INVENTION

Figure 1:
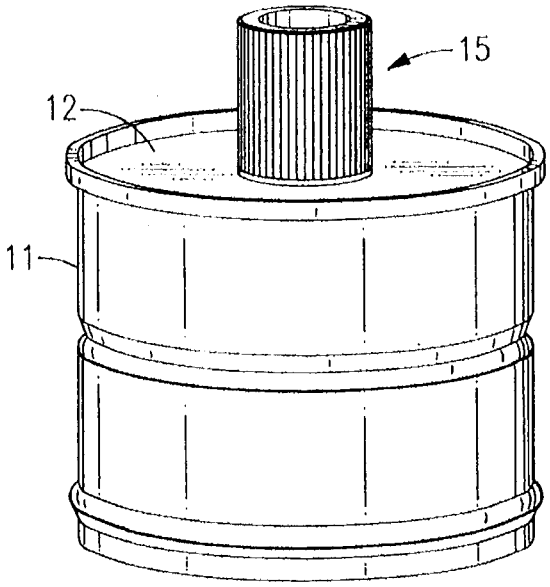
FIG. 1 is a perspective view of a disposable fuel cell embodying the teachings of the present invention.

Turning now to FIG. 1, there is shown a disposable liquid fuel cell, generally referenced 10, of the type typically used to warm chafing dishes and the like. The fuel cell includes a cylindrical body or reservoir 11 for holding a quantity of liquid fuel. The body is closed by a lid 12 in which a burner 13 (FIG. 2) is centrally mounted. A removable cap 15 is press fitted over the burner to close the cell and protect the burner wick when the cell is not being used.

Figure 2:
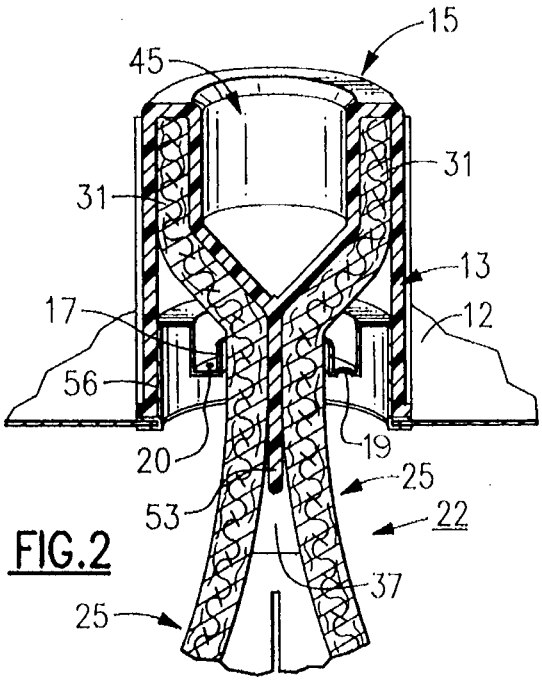
FIG. 2 is an enlarged partial perspective view in section showing the fuel cell burner and the cap used to close the burner positioned over the burner and the burner wick.

The operation of the burner 13 is described in greater detail in the previously noted U.S. Pat. Nos. 5,211,553 and 4,526,530, the disclosures of which are incorporated herein by reference. The burner is formed from a single sheet of metal and is crimped into an opening centrally formed in the lid with the burner communicating with the burner reservoir. As illustrated in FIG. 2, the burner includes a centrally mounted hollow stud 17 that is surrounded by an annular trough 20 containing one or more drain and primary vent holes 19. A split or divided wick 22 passes through the stud with the extended or distal end of the wick terminating in two raised adjustable tabs.

Figure 3:
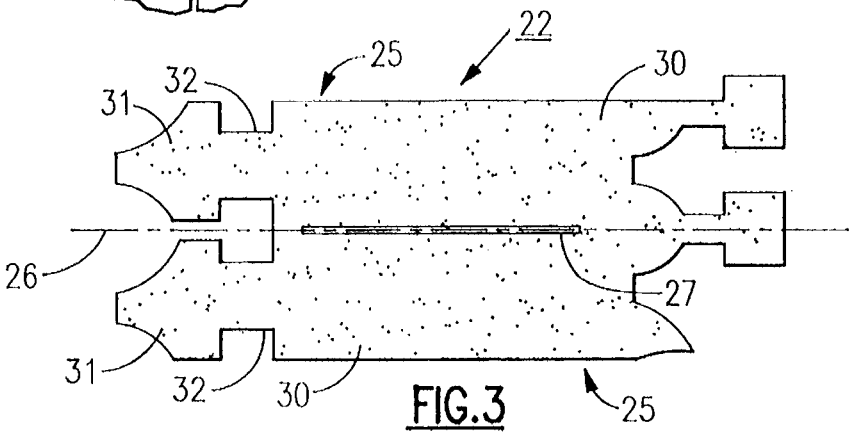
FIG. 3 is a plan view showing the construction of the wick utilized in the present burner.

As illustrated in FIG. 3, the divided wick 22 is die cut from a single piece of wicking material and includes two symmetrical half sections 25–25, which, in assembly, are folded over in face-to-face relationship along a common axis 26. A longitudinal slit 27 is cut along the common axis to facilitate folding prior to the wick being passed through the burner stud.

Each half section of the wick further includes a body segment 30 and a triangular shaped distal tab 31 which is joined to the body segment by a neck 32. The length of the neck is equal to or slightly greater than the axial length of the burner stud. In assembly, the wick is folded along its axis and is passed upward through the stud to position the two neck sections within the stud. This, in turn, positions the two wick tabs above the top surface of the stud. The two body segments of the wick are allowed to unfold in the fuel reservoir thereby helping to prevent the wick from being pulled further through the stud. The body segments are wetted by the fuel in the reservoir and the fuel is drawn by capillary action upwardly into the tab region where it can be burned in air to provide the desired heating. Excess fuel which oversaturates the wick is collected in the trough 20 surrounding the stud and returned to the reservoir through the primary vent and drain holes 19.

The fuel reservoir must be properly vented to insure that the fuel is efficiently wicked and burned. To this end, a secondary vent passage 37 is provided between the two half sections of the wick. As noted above, under certain conditions, the wick can become tightly packed within the stud resulting in closing of the vent passage. As will be explained in greater detail below, the apparatus of the present invention is designed to eliminate problems associated with over-tight wicks or clogged vent passages.

Figure 4:
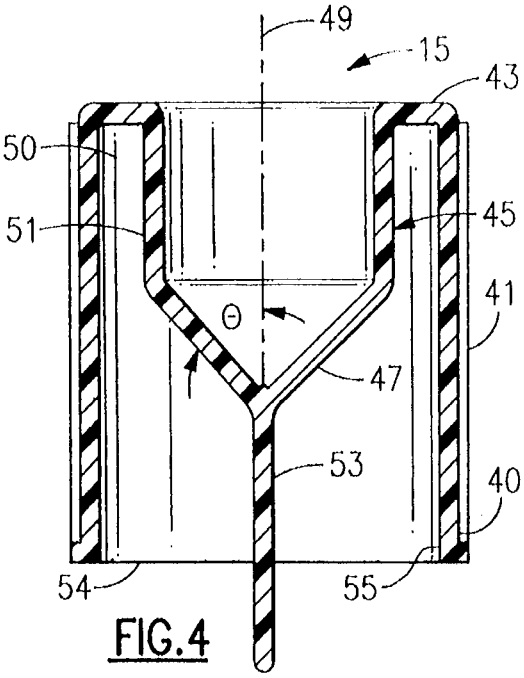
FIG. 4 is an enlarged sectional plan view of the burner cap showing an impression die and a probe that are mounted inside the cap in greater detail.

With further reference to FIG. 4, the present fuel cell is equipped with a single piece cap 15 that is molded from plastic. The cap includes an outer housing 40 that is arranged to pass over the burner to protect the burner and the wick tabs when the cell is not being used. Although the housing can take any suitable shape, it is shown here as being cylindrical in form. The outer surface of the housing has a series of longitudinally aligned serration 41 that facilitate easy gripping of the cap. The housing further includes an annular top wall 43 from which depends an impression die 45. The die is a cylindrical member that is coaxially aligned with the housing so that an annular space 50 that is about equal to the wick thickness is formed between the outer surface of the impression die and the inner surface of the housing.

The axial length of the die is about half that of the housing. The die further contains a conical shaped bottom wall 47, the apex of which lies on the axis 49 of the housing. Preferably, the bottom wall forms an angle θ of between 40° and 50° with the axis of the housing.

An elongated probe 53 extends downwardly from the tip or apex of the bottom wall of the impression die. The probe is aligned along the axis of the housing and passes through the bottom opening 54 of the cap.

As illustrated in FIG. 2, the cap is adapted to close downwardly over the burner and the distal tabs of the wick. The inner surface 55 of the housing is press fitted upon the outer surface 56 of the burner to secure the cap in place at closure. During closure, the cap probe is inserted between the two half sections of the wick and is passed downwardly through the stud. The probe is withdrawn from the burner when the cap is removed, leaving behind a clear unobstructed vent passage thus insuring efficient operation of the burner. In the event the passage becomes clogged for any reason, the passage can be reopened by simply replacing the cap upon the burner.

Closing the cap over the burner also causes the divided tabs of the wick to be directed along the conical bottom wall of the impression die into the annular space 50 provided between the die and the housing. The die is contoured to shape the tabs so that they will assume a desired setting for delivering standard heat and retain this setting when the cap is removed from the burner. In the event the user wishes to adjust the wick to a different setting, he or she may do so manually. Upon replacement of the cap, the tabs will automatically be returned to a standard heat setting for the impression die.

While this invention has been explained with reference to the structure disclosed herein, it is not confined to the details set forth and this invention is intended to cover any modifications and changes as may come within the scope of the following claims:

What is claimed is:

1. A cap for closing a fuel cell burner, said cap including, an elongated outer housing having a bottom opening, said housing being press fitted over and to close said burner and protectively enclose a burner wick having upwardly extended adjustable tabs, an impression die mounted inside said housing that is arranged to move between said tabs and place said tabs in a predetermined setting when said cap is press fitted over said burner, and a downwardly disposed probe mounted upon the impression die that is insertable between said tabs to guide said die therebetween.

2. The cap of claim 1 wherein said probe extends beyond the bottom opening in said cap.

3. The cap of claim 2 wherein said probe is of sufficient length so that it passes through the burner when the cap is press fitted upon said burner to open a venting passage through said wick.

4. The cap of claim 1 wherein said housing is cylindrical in shape and said impression die is a cylindrical member axially aligned in said housing.

5. The cap of claim 4 wherein said cylindrical impression die member further includes a contoured bottom wall for directing the wick tabs between the cylindrical die member and the housing.

6. The cap of claim 5 wherein said contoured bottom wall is conically shaped with the apex of the cone lying on the axis of the housing.

7. The cap of claim 4 wherein said cylindrical impression die member is suspended from the top of said housing and has an axial length that is less than that of said housing.

8. The cap of claim 1 wherein said cap is a single piece of molded plastic.

9. A liquid fuel cell that includes a container that includes a reservoir for storing a quantity of liquid fuel and a lid for closing the top of said reservoir, a burner mounted in said lid, said burner containing a vertically disposed stud of predetermined length that is in communication with said reservoir, a wick mounted in said stud, said wick having a pair of upraised adjustable tabs extending above the stud, an open bottom removable cap press fitted over said burner to close the burner and protect the wick, and an impression die mounted inside said cap for shaping the wick tabs to a desired configuration.

10. The fuel cell of claim 9 that further includes a probe depending from the impression die for guiding the die between said wick tabs.

11. The fuel cell of claim 10 wherein the probe extends through the opening in the bottom of said cap.

12. The fuel cell of claim 11 wherein the cap includes a cylindrical outer housing and said impression die is a smaller diameter cylindrical member that is coaxially aligned with said housing to provide an annular space therebetween.

13. The fuel cell of claim 12 wherein said cylindrical die member is suspended from the top of said housing and has an axial length less than that of said housing.

14. The fuel cell of claim 13 wherein said cylindrical member further includes a conical bottom wall, the apex of the cone lying upon the axis of the housing.

15. The fuel cell of claim 14 wherein the probe is mounted upon the apex of said cone shaped bottom wall and has an axial length so that the probe passes through the burner of said fuel cell into said reservoir.

16. A cap for closing a fuel cell burner, said cap including, an elongated outer housing having a bottom opening, said housing being press fitted over a raised burner mounted on a top wall of an enclosed fuel cell and protectively enclosing a burner wick having upwardly extended adjustable tabs, said outer housing having an inner surface that is press fittable against an outer surface of said burner to removably secure the housing to said burner, and an impression die, having a conical shaped bottom wall, said impression die being mounted inside said housing and being arranged to move between said wick tabs to place said wick tabs in a predetermined setting when said cap is press fitted over said burner.

* * * * *